US011497359B2

(12) United States Patent
Bagherzadeh et al.

(10) Patent No.: US 11,497,359 B2
(45) Date of Patent: Nov. 15, 2022

(54) DISPENSER WITH TEAR UNIT

(71) Applicant: Essity Hygiene and Health Aktiebolag, Gothenburg (SE)

(72) Inventors: Ali Bagherzadeh, Gothenburg (SE); Per Möller, Borlänge (SE); Martina Johansson, Borlänge (SE); John Hulterström, Gothenburg (SE); Yves Stoeffler, Kunheim (FR)

(73) Assignee: ESSITY HYGIENE AND HEALTH AKTIEBOLAG, Gothenburg (SE)

( * ) Notice: Subject to any disclaimer, the term of this patent is extended or adjusted under 35 U.S.C. 154(b) by 0 days.

(21) Appl. No.: 17/440,283

(22) PCT Filed: Mar. 19, 2019

(86) PCT No.: PCT/EP2019/056854
§ 371 (c)(1),
(2) Date: Sep. 17, 2021

(87) PCT Pub. No.: WO2020/187402
PCT Pub. Date: Sep. 24, 2020

(65) Prior Publication Data

US 2022/0087487 A1 Mar. 24, 2022

(51) Int. Cl.
*A47K 10/38* (2006.01)
*A47K 10/36* (2006.01)
(Continued)

(52) U.S. Cl.
CPC ..... *A47K 10/3827* (2013.01); *A47K 10/36* (2013.01); *A47K 10/3836* (2013.01);
(Continued)

(58) Field of Classification Search
None
See application file for complete search history.

(56) References Cited

U.S. PATENT DOCUMENTS 5,211,308 A * 5/1993 Decker ..... A47K 10/3818 221/303
2010/0176021 A1 7/2010 Gordon
(Continued)

FOREIGN PATENT DOCUMENTS

CN 2770554 Y 4/2006
CN 201346174 Y 11/2009
(Continued)

OTHER PUBLICATIONS

Office Action dated Nov. 15, 2021, issued in the corresponding Chinese Patent Application No. 201980092178.4, 20 pages including 11 pages of English Translation.
(Continued)

*Primary Examiner* — William A. Rivera
(74) *Attorney, Agent, or Firm* — Buchanan Ingersoll & Rooney P.C.

(57) ABSTRACT

A dispenser for dispensing web of paper, the dispenser including a housing, a dispensing opening defined in the housing for dispensing paper. A tear unit is arranged at the dispensing opening for facilitating tear of the paper upon moving the tissue paper over the tear unit. The tear unit includes a tear unit body, and the tear unit body includes a friction surface provided with an elastomer. The elastomer includes rounded protrusions distributed along the friction surface such as to facilitate tearing during dispensing.

20 Claims, 4 Drawing Sheets

(51) Int. Cl.
*B26F 3/02* (2006.01)
*A47K 10/32* (2006.01)

(52) U.S. Cl.
CPC ..... *B26F 3/02* (2013.01); *A47K 2010/3253* (2013.01); *Y10T 225/282* (2015.04)

(56) References Cited

U.S. PATENT DOCUMENTS

| | | | | |
|---|---|---|---|---|
| 2014/0239035 | A1* | 8/2014 | Achton | A47K 10/32 225/16 |
| 2014/0246469 | A1* | 9/2014 | Forsaeus | A47K 10/38 225/72 |

FOREIGN PATENT DOCUMENTS

| | | | |
|---|---|---|---|
| CN | 101683250 | A | 3/2010 |
| CN | 205268017 | U | 6/2016 |
| CN | 105832233 | A | 8/2016 |
| CN | 208339455 | U | 1/2019 |
| CN | 208355322 | U | 1/2019 |
| EP | 0107487 | A1 | 5/1984 |
| GB | 2390357 | A | 1/2004 |

OTHER PUBLICATIONS

International Preliminary Examining Authority (PCT/IPEA/409) dated Jan. 19, 2021, by the European Patent Office for International Application No. PCT/EP2019/056854.

International Search Report (PCT/ISA/210) and Written Opinion (PCT/ISA/237) dated Nov. 12, 2019, by the European Patent Office as the International Searching Authority for International Application No. PCT/EP2019/056854.

Response to the Written Opinion accompanying the International Search Report and Office Action dated Nov. 11, 2020 in International Application No. PCT/EP2019/056854.

* cited by examiner

DISPENSER WITH TEAR UNIT

TECHNICAL FIELD

A dispenser for dispensing web of paper, the dispenser comprising a housing, a dispensing opening defined in the housing for dispensing paper, and tear unit arranged at the dispensing opening for facilitating tear of the paper upon moving the tissue paper over the tear unit.

BACKGROUND

Tissue paper dispensers in public washrooms are often provided with continuous, perforated or non-perforated, web of tissue paper rolls allowing the user to decide how much tissue paper she wants to use. In some dispensers the user uses two hands to separate the continuous tissue paper at preferred length. In other dispensers the user pulls or jerks the tissue paper against tear means arranged at the dispenser opening such that the tissue paper tears in order to achieve a separated portion of desired length. Existing tear means are often sharp, teeth-like, in order to provide good rapture of the tissue paper. Sharp tear means can however be perceived as unpleasant if, as happens occasionally, the user accidently brushes against the tear means with her hand when reaching for the free end, usually referred to as the tail, of the tissue paper to initiate dispensing. Additionally, the sharpness of such tear means wear out over time and their effectiveness decrease correspondingly.

Another issue with conventional tear means is inconsistent performance, i.e. incidents of unsuccessful tear off and shredding of the tissue paper.

Hence, there is a need for a dispenser for dispensing web of paper with improved means for initiating the tear and separation of the web of paper.

SUMMARY

It is desired to provide a tear unit, and a dispenser comprising such tear unit, with improved functionality in terms of providing reliable and consistent separation or tear of the web of paper during dispensing.

The disclosure relates to a dispenser for dispensing web of paper, the dispenser comprising a housing, a dispensing opening defined in the housing for dispensing paper, a tear unit arranged at the opening for facilitating tear of the paper upon moving the tissue paper over the tear unit when pulling the paper out from the housing through the dispensing opening. The tear unit comprising a tear unit body, and the tear unit body comprises a friction surface provided with an elastomer, and the elastomer comprises rounded protrusions being distributed along the friction surface such as to facilitate tearing during dispensing.

The web of paper may be continuous or perforated across the width of the web. The elastomeric protrusions provide friction such as to facilitate the separation of web of paper by initiating tear of the continuous web of paper or perforated web of paper. Tearing of a perforated paper includes breaking the perforations or tearing of the web between perforations. The friction provided by the elastomeric rounded protrusions is higher than the friction provided by a tear unit friction surface not provided with an elastomer comprising rounded protrusions, e.g. tear means of polyolefins.

The separation is efficient and reliable due to the combination of the elastomer and protrusions thereof, and the break in the web of paper will consistently occur near the tear unit. A paper tail will thus always be present in the dispenser for the next user to grab. An accessible tail makes it easier for the next user to grasp the tissue paper and initiate the dispensing.

Moreover, the tear unit disclosed herein provides a soft feeling for the user if the user brushes against the tear unit. It is hence more pleasant for the user to touch than conventional plastic teeth of a different geometry.

The protrusions may be rounded in all directions, i.e. slanting from the top of the protrusions towards the friction surface from which they protrude. The protrusions being rounded in all directions rather than jagged provides a softer surface in comparison to jagged teeth. Examples of protrusions rounded in all directions include but are not limited to hemisphere-shaped, dome-shaped or oval dome-shaped.

The surface of each protrusion on the tear unit may or may not be uniform, i.e. the slanted sides of a protrusion may or may not have the same inclination. Moreover, all protrusions provided at the tear unit may be of the same shape and the same dimensions or may of different shapes and dimensions.

In another example the protrusions have a continuous wave-shape extending along the tear unit.

The elastomer covers the friction surface. The elastomer may also be provided at the adjacent surfaces of the friction surface, i.e. the inner surface of the tear unit body facing the interior of the dispenser and the outer surface of the tear unit body facing outwards such as to enclose the edges of the friction surface. The elastomer may extend to the same extent at the inner surface and at outer surface or extend more at the inner surface or at the outer surface of the tear unit body. The tear unit body may be provided with recessed portions along its inner surface and outer surface adjacent the friction surface, the recessed portions being covered by the elastomer.

The rounded protrusions are arranged at a center-to-center distance (cc) from each other. The distance (cc) may be larger than the maximum diameter of the rounded protrusions, measured at the friction surface. The rounded protrusions may be evenly distributed along the friction surface such that the distance cc is the same between each protrusion along the entire tear unit. The distance cc is preferably 0.5-1.5 cm, more preferably 0.8 to 1.2 cm, and most preferably about 1 cm. A distance between the protrusions of 0.5 cm-1.5 cm gives an effective and smooth tear off. If the protrusions are arranged at a distance too close to each other, with cc less than 0.5 cm, the tissue paper tends to glide over the protrusions, and no separation/tear is initiated. A distance between the protrusions larger than 1.5 cm cc renders few points of interaction between the protrusions and the web of paper and thus effects the ability to initiate the separation of the web of paper at or close to the tear unit.

The diameter of the protrusions may be less than the distance at which they are separated, thereby providing a surface in between the protrusions. The protrusions are an integral part of the elastomer provided to the friction surface such that the surface between the protrusions as well as the protrusions are made of the elastomer material.

The protrusions may have a height/diameter ratio of about 2/3, the diameter being the average diameter measured at the friction surface. The given ratio provides smooth rounded protrusions which are soft to touch and visually appealing.

The height of the protrusions may be less than 4 mm, more preferably less than 2.5 mm and preferably about 2 mm. Elastomeric rounded protrusions of a height less than 4 mm are smooth and less conspicuous than higher teeth, but still provide points of friction interaction with the web of paper to initiate the tear. The rounded protrusions of the given height will thus provide a distinct tear without being conspicuous to users. It thereby gives the dispenser an appealing appearance. The minimum height is preferably 1 mm in order to get sufficiently effective tear even after some wear of the elastomer over time.

The diameter may differ in different directions of the rounded protrusion, e.g. if the protrusions are oval (seen from above).

The elastomer may be a thermoplastic elastomer (TPE), such that the rounded protrusions are made of thermoplastic elastomer. Thermoplastic elastomer material is known in the art. Non-limiting examples of thermoelastic material include Styrenic block copolymers TPS (TPE-s), Thermoplastic polyolefinelastomers TPO (TPE-o), Thermoplastic Vulcanizates TPV (TPE-v or TPV), Thermoplastic polyurethanes TPU (TPU), Thermoplastic copolyester TPC (TPE-E) and Thermoplastic polyamides TPA (TPE-A).

A non-limiting example of thermoplastic elastomer that may be used is Dryflex (#500805) by Hexpol TPE AB in Sweden; a TPS-SEBS. Dryflex #500805 has a hardness (Shore A durometer) of 80 (ASTM D2240).

The thermoplastic elastomer may have a hardness of 70-90 Shore A, preferably 75-85 Shore A, most preferably about 80 Shore A (ASTM D 2240). Thermoplastic elastomeric material of such hardness is flexible, soft to touch, provide friction and is wear resistant. Rounded protrusions of hardness less than 70 Shore A are sticky, hence rendering the tail to stick to the tear unit after separation (no free-hanging tail present for the next user). TPE material of hardness 70-90 Shore A is less sticky than softer TPEs, and hence does not attract dirt/dust to any noticeable extent.

The friction coefficient (COF) may be 25-40, which allows the elastomeric rounded protrusions to achieve effective initiation of the tear at the tear unit. Friction is measured with ASTM D 1894.

Non-limiting examples of thermoplastic elastomers which may be used with the tear unit according to the disclosure is a TPE having 80 Shore A and COF about 30, a TPE having 85 Shore A and COF about 25 and a TPE having 70 Shore A and COF about 35.

Thermoplastic elastomeric material is flexible and fatigue resistant, thus providing long lasting shape stability. In a dispenser used in a high traffic public restroom it is important that the tear off feature withstands the wear of web of paper over time, as the dispenser might get used several hundred thousand times during its lifetime. The rounded protrusions should thus withstand 500'000 dispensing incidents without losing its ability to provide efficient tear. TPEs provide great abrasion resistance (ASTM D 5963).

The thermoplastic elastomer may comprise other additives to enhance the properties of material.

The thermoplastic elastomer may be overmolded onto the tear unit body. The tear unit body comprises polyolefins, preferably polypropylene (PP) and/or polyethylene (PE). TPE may be injection molded onto polyolefin tear unit body without binding additives, and the resulting tear unit is thereby more resistant to discoloring. The tear unit body may comprise recessed portions along its inner surface and its outer surface adjacent the friction surface. The recessed portions provide improved attachment between the tear unit body and the thermoplastic elastomer during injection molding.

In a non-limiting example, the dispenser housing can be of Acrylonitrile butadiene styrene (ABS) material. In such a case the tear unit is a separate unit which can be retrofitted to the dispenser and may also be exchangeable.

The housing may comprise a housing body and a cover, the cover allowing access into the housing for refilling the dispenser. The tear unit may be integral with the cover or a non-integral part of the cover or arranged in the dispenser as a separate unit with respect to the cover.

The dispensing opening may, if there is more than one roll in the dispenser, be partly covered by a sliding door.

The tear unit may be arranged at least at one edge defining the dispensing opening. In an example where the dispenser comprises a cover at least one of the edges defining the dispensing opening is arranged in the cover, and the tear unit is arranged at least at one edge defining the dispensing opening when the dispenser is closed.

The dispenser may be a roll dispenser. A roll dispenser may comprise at least one roll holder for rotatably supporting an axis of a roll of paper or be arranged to support the roll in the dispenser by other means. If a roll holder is present the extension of the at least one roll holder intended to support the paper roll when arranged in the dispenser extend in a direction parallel to the direction of the central axis of the paper roll.

According to one non-limiting example the dispenser is a roll dispenser and the tear unit is arranged to mainly extend in a direction parallel to the direction of the central axis of a paper roll when arranged in the dispenser such that the outer cylindrical surface of the paper roll faces the tear unit during dispensing. With this orientation the tear unit extends transversely across the roll of tissue paper, without direct contact with the roll. In such dispensers the at least one roll holder is arranged parallel to the back of the dispenser, such that the central axis of a roll of tissue paper placed in the dispenser is arranged horizontally in the dispenser. Such a roll orientation in a dispenser, when the paper tail faces the user, is sometimes referred to as a "water fall" orientation. The roll may also be places such that the tail of the paper is at the back of the dispenser and the paper is pulled from underneath. These are examples of horizontal dispensing.

According to another non-limiting example the dispenser is a paper roll dispenser, and the tear unit is arranged to mainly extend in a direction perpendicular to the direction of the central axis of the paper roll such that a side of the paper roll faces the tear unit during dispensing. In such dispenser the at least one roll holder is arranged perpendicular to the back of the dispenser, such that the central axis of the roll of tissue paper placed in the dispenser is arranged vertically in the dispenser.

The tear unit may be arranged at a distance from the roll holder such that the tear unit is not in contact with the roll of paper when the dispenser is not used, and the tail of the paper roll comes into contact with the tear unit upon moving the paper tail over the tear unit during dispensing. The distance between the central axis of the roll holder and the outer periphery of a full paper roll arranged on the roll holder is smaller than the distance between the central axis of the roll holder and the tear unit.

By not being in constant contact with the roll of paper the tear unit does not hinder the roll of paper from rotating freely so that a desired length of tissue paper can be pulled from the roll before the paper tail is moved over the tear unit for separating a desired length of tissue paper from the roll.

In one non-limiting example the dispenser is a dispenser for dispensing stacks of paper. In such a dispenser the tear unit is arranged to mainly extend in a direction parallel to the direction of the width of a stack of paper when arranged in the dispenser, such that the unfolding surface of the stack of paper faces the tear unit during dispensing. The stacks may comprise continuous web of paper, or folded sheets.

One type of web of paper suitable for the dispenser with the tear means described herein is tissue paper. In one non-limiting example the paper is toilet tissue paper. Toilet tissue paper has a basis weight of 14-22 g/m$^2$ and can be of one, two, three, four plies etc. It may be perforated or unperforated. The tensile strength in MD (machine direction) may be 100-500 N/m (for the mother reel not the finished product).

The disclosure also relates to a method for manufacturing a tear unit for a dispenser for dispensing web of paper. The method comprises providing a tear unit body comprising a friction surface and providing the friction surface with a thermoplastic elastomer by injection molding, the thermoplastic elastomer comprising rounded protrusions, and the rounded protrusions are distributed along the friction surface.

The disclosure also relates to a tear unit for a dispenser for dispensing web of paper, the tear unit comprising a tear unit body, the tear unit body comprising a friction surface provided with an elastomer, and wherein the elastomer comprises rounded protrusions distributed along the friction surface such as to facilitate tearing during dispensing of paper. The protrusions may be rounded in all directions. The protrusions may be hemisphere-shaped, dome-shaped, oval-shaped or any other suitable shape. The protrusions may also have a continuous wave-shape extending along the tear unit. The rounded protrusions may be evenly distributed along the friction surface. The rounded protrusions are arranged at a center-to-center distance (cc) from each other, the distance (cc) being larger than the maximum diameter of the rounded protrusions. The protrusions may have a height/diameter ratio of about 2/3. The diameter used for the height/diameter ratio being the average diameter of the rounded protrusions measured at the friction surface. The diameter may differ in different directions of the rounded protrusion, e.g. if the protrusions are oval (seen from above). The height of the protrusions is less than 4 mm, more preferably less than 2.5 mm and preferably about 2 mm. The minimum height is preferably 1 mm in order to get sufficiently effective tear and withstand wear over time.

In one non-limiting example the elastomer of the tear unit may be a thermoplastic elastomer as described above. The thermoplastic elastomer may have a hardness of 70-90 Shore A, preferably 75-85 Shore A, most preferably about 80 Shore A. The thermoplastic elastomer may be overmolded onto the tear unit body. The tear unit body may comprise polyolefins, preferably polypropylene and/or polyethylene.

"Rounded protrusions" used herein refer to protrusions that are blunt and does not have sharp edges. The top of the protrusion is curved, such that there is no pointy peak. The sides of the rounded protrusion are slanting from the top towards the friction surface.

"Friction surface" used herein refer to the rim, also referred to as the outer edge surface, of the dispensing opening when the tear unit is arranged at the dispensing opening. The friction surface is the main surface that the web of paper touches when being pulled over the tear unit body. The friction surface is covered with an elastomer. In a non-limiting example, the elastomer can be provided over the adjacent surfaces of the friction surface as well, i.e. provided at the inner surface and outer surface of the tear unit body.

"Tear" and "tearing" used herein refer to separation of the web of paper across the width of the paper. It includes separation of the web of paper at perforations or between perforation of a perforated paper, and separation across a non-perforated continuous web of paper.

BRIEF DESCRIPTION OF THE FIGURES

The disclosure herein is illustrated by way of examples and not limited to the accompanying figures, in which like references indicate similar elements.

DETAILED DESCRIPTION

It is to be understood by one of ordinary skill in the art that the following is a description of example embodiments only, and is not intended as limiting the broader aspects of the present disclosure.

Figure 1A:
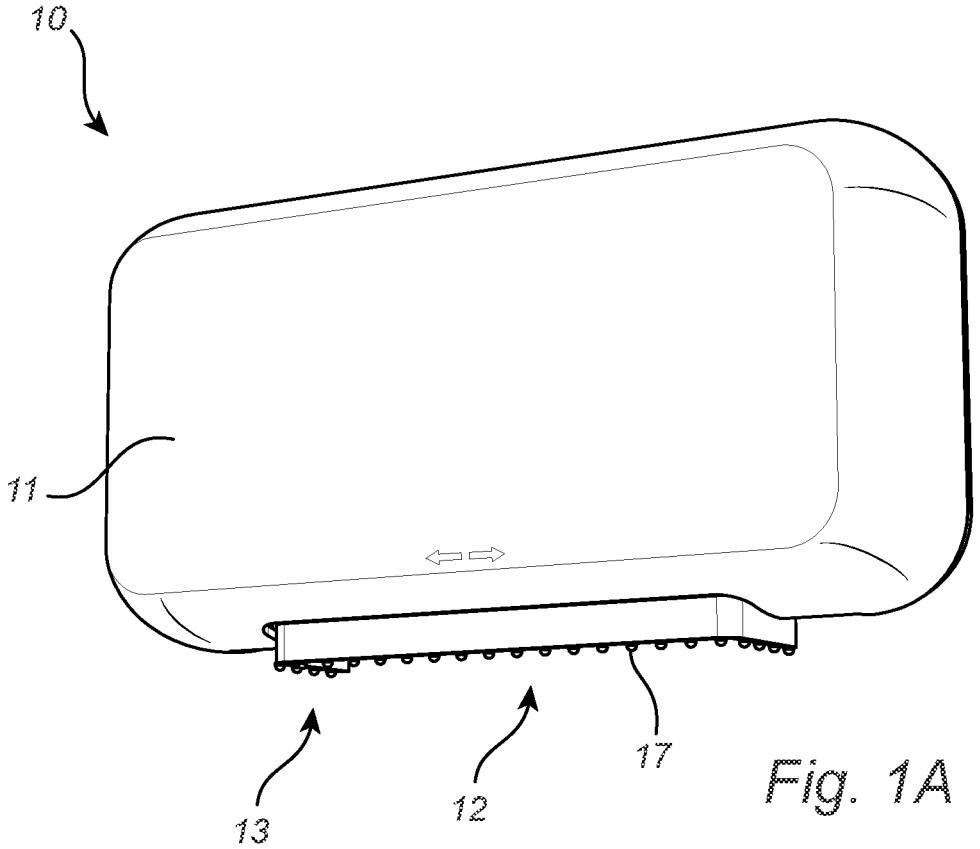
FIG. 1A is a perspective view of a dispenser with tear unit as disclosed herein.
Figure 1B:
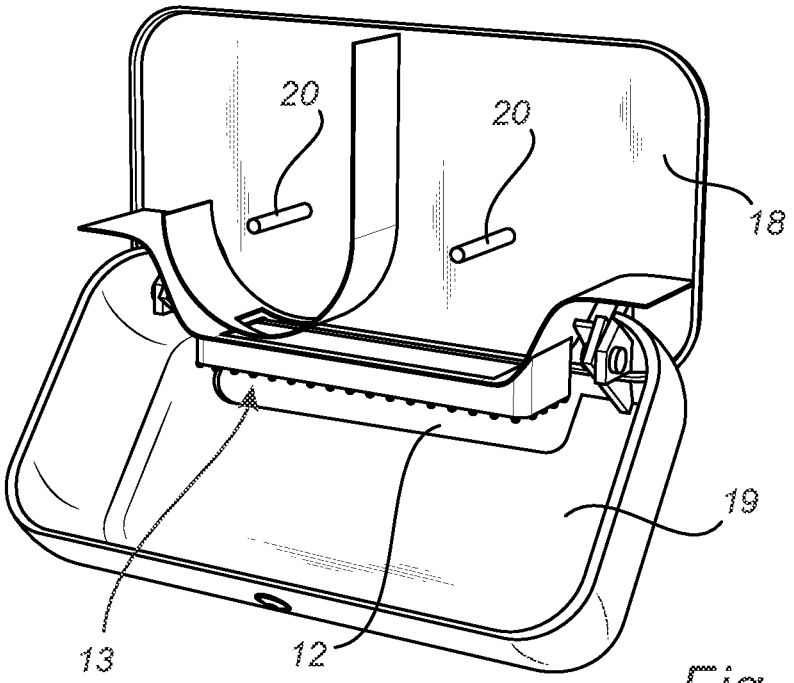
FIG. 1B is a perspective view of the dispenser of FIG. 1A with the lid of the dispenser being open.

FIG. 1A shows a wall-mounted dispenser 10 comprising a housing 11 enclosing two rolls of tissue paper, the housing 11 comprising a housing body 18 and a cover 19. The cover 19 is a hinged lid providing access to the interior of the dispenser 10 thereby allowing the roll of tissue paper to be replaced, as illustrated in FIG. 1B. Two roll holders 20 extend perpendicular from the back wall of the housing body 18, the roll holders 20 each being intended to hold a roll of continuous tissue paper in the housing 11.

A dispensing opening 12 allowing access to the rolls for dispensing paper through the dispensing opening 12 is arranged at the bottom of the dispenser 10, the dispensing opening 12 facing downwards when the dispenser 10 is mounted on a wall, such that the tail of the roll of tissue paper is hanging freely down towards the dispensing opening 12. The dispensing opening 12 allows the user to readily access and grab the tail of the tissue paper roll. If the paper tail of the roll is not visible, the user can access the roll inside the dispenser 10 through the dispensing opening 12.

The dispensing opening 12 is provided with a tear unit 13, the tear unit 13 delimiting the front and sides of the dispensing opening 12, as shown in FIG. 1*a*. The tear unit 13 is attached at its ends to the back wall of the housing body 18. The tear unit extends below the edge of the cover 19 when the cover 19 is closed, such as to delimit the dispensing opening 12 formed by the housing body 18 and the cover 19. The tear unit 13 comprises a tear unit body 14, the tear unit body 14 is provided, by overmolding, with a thermoplastic elastomer 16 which comprises rounded protrusions 17 evenly distributed along a friction surface 15 of the tear unit 13, the friction surface facing downwards away from the interior of the housing 11. The rounded protrusions 17 are uniformly rounded on all sides, forming raised hemispherical knobs.

The tear unit 13 is not in contact with the outer cylindrical surface of the roll of paper. The tail of the tissue paper roll hangs freely downwards, not touching the tear unit 13, so the tear unit 13 comes into contact with the paper tail only when a user is pulling the tissue paper tail over the tear unit 13 during dispensing in order to separate a piece of paper from the paper roll.

Figure 2:
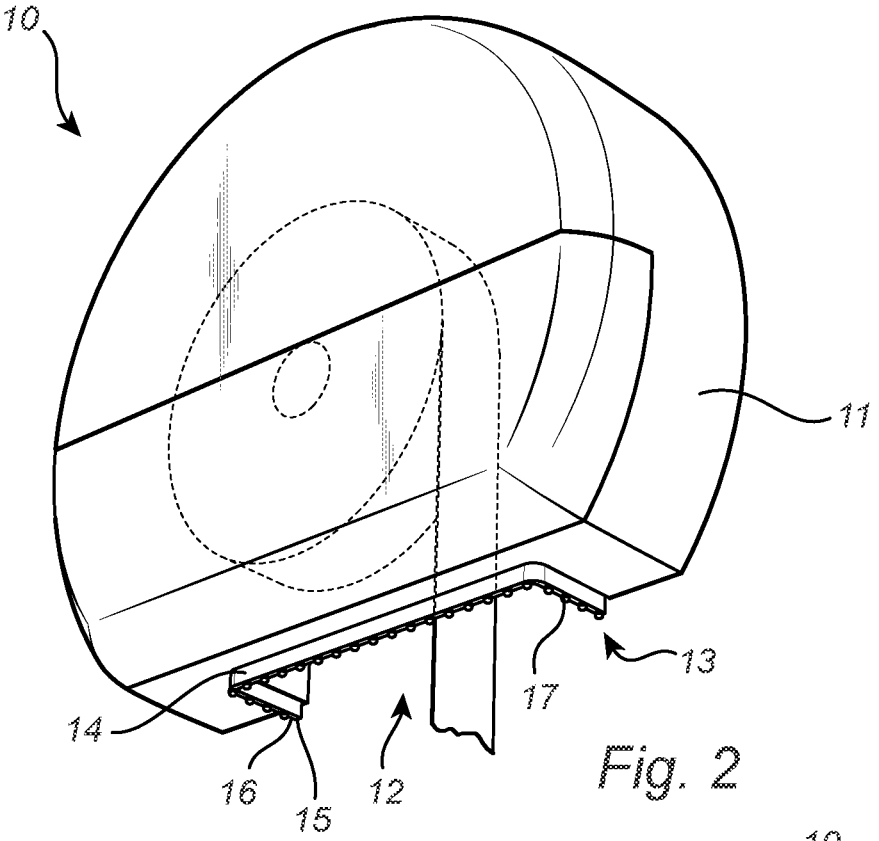
FIG. 2 is a perspective view of another dispenser with tear unit as disclosed herein.

FIG. 2 shows a wall-mounted dispenser 10 comprising a housing 11 enclosing a roll of paper, the housing 11 comprising a housing body 18 and a cover 19. A roll holder 20 is arranged to extend perpendicular from the back wall of the dispenser 10, the roll holder 20 holding a roll of continuous paper in the housing 11. The cover 19 is a hinged lid providing access to the interior of the dispenser 10 thereby allowing the roll of tissue paper to be replaced. A tear unit 13, being an integral part of the hinged lid, is arranged so as to define the dispensing opening 12 through which paper can be dispensed. The tear unit 13 is arranged at the side edges as well as the front edge of the dispensing opening 12. The paper is pulled against a frictions surface on the tear unit 13 by the user when the user wishes to separate a piece of paper from the roll of paper. The friction surface 15 is provided with a thermoplastic elastomer 16, and rounded protrusions 17 made of thermoplastic elastomer 16, providing friction which allows the paper to separate at or close to the tear unit 13.

Figure 3:
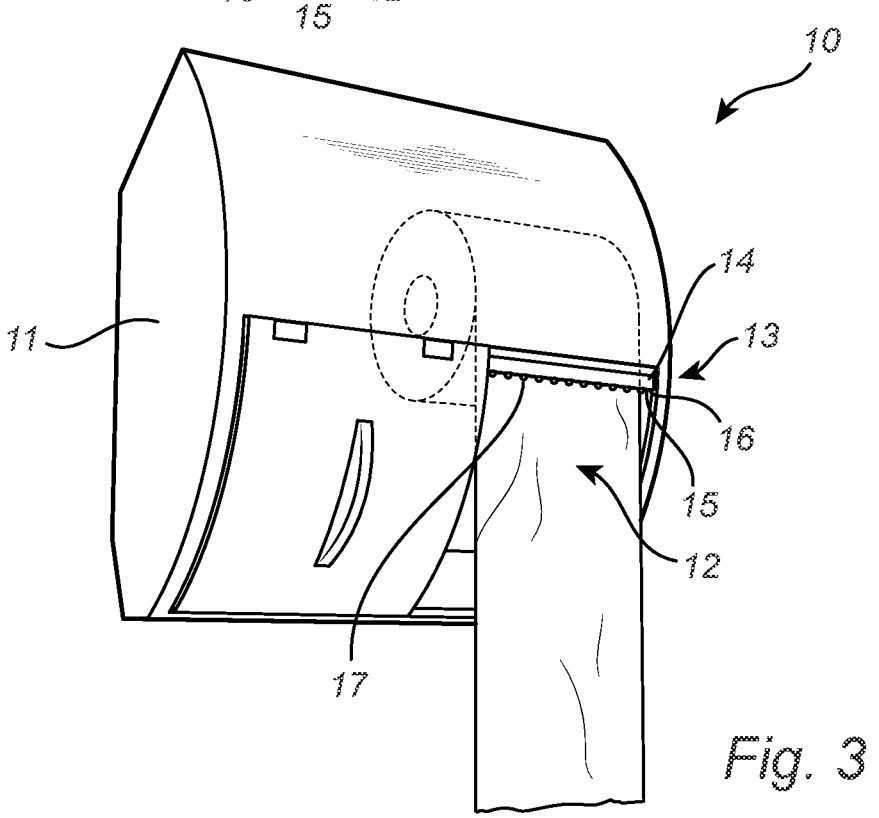
FIG. 3 is a perspective view of another dispenser with tear unit as disclosed herein.

FIG. 3 shows a wall-mounted dispenser 10 for two rolls of tissue paper. The dispenser 10 has a housing 11 comprising a housing body 18 and a cover 19, the cover 19 being a hinged lid allowing access to the interior of the dispenser 10 such that the user can replace the rolls. A dispensing opening 12 is arranged at the front of the dispenser 10, facing outwards when the dispenser 10 is mounted on the wall. The dispensing opening 12 provides access to the roll during dispensing, and the outer cylindrical surface of the roll is visible at the dispensing opening 12 when the roll is full. The rolls are arranged in the dispenser 10 such that the outer cylindrical surface of the roll faces the dispensing opening 12 and the tail of the tissue paper roll is hanging freely facing the dispensing opening 12. The dispensing opening 12 is partly covered by a slidable cover door allowing only one roll at a time to be accessed.

The dispensing opening 12 is provided with a tear unit 13 at its upper outer edge. The tear unit 13 comprises a thermoplastic elastomer 16 comprising rounded protrusions 17 evenly distributed along a friction surface 15 of the tear unit 13. During dispensing the user pulls the free hanging tail downwards to achieve a paper length of desire, and then pulls the tissue paper over the tear unit 13 to separate it from the roll. The tissue paper comes into contact with the tear unit 13 once the user grabs the tail and pulls is towards and over the tear unit 13, and the friction exerted by the thermoplastic elastomer 16 protrusions 17 at the friction surface 15 facilitate the separation of the tissue paper.

Figure 4:
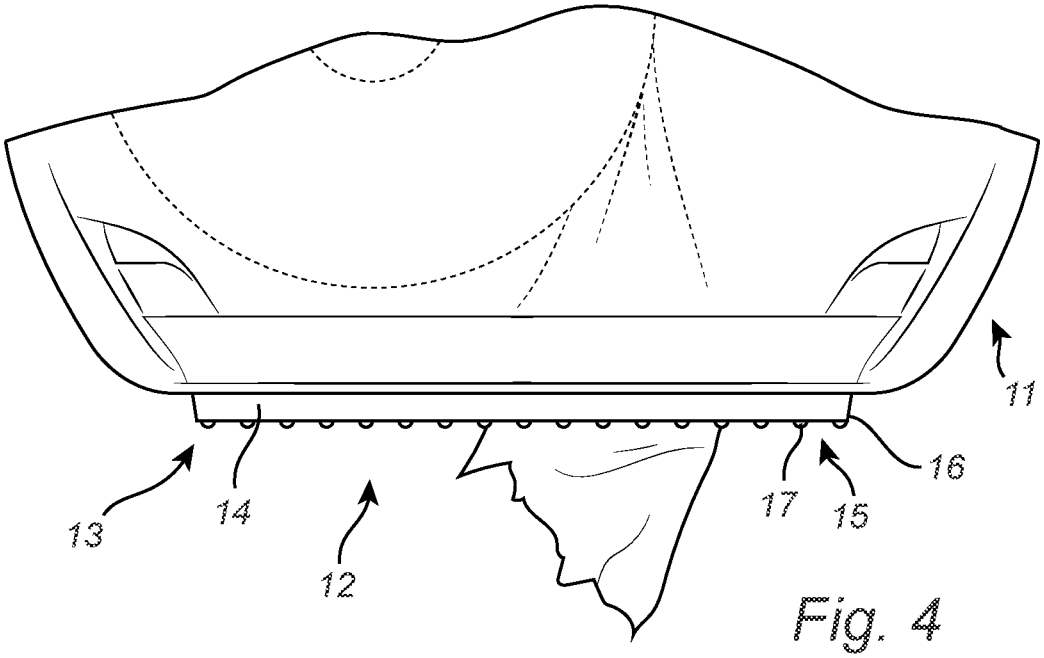
FIG. 4 is a front view of the lower part of the dispenser of FIG. 2.
Figure 5:
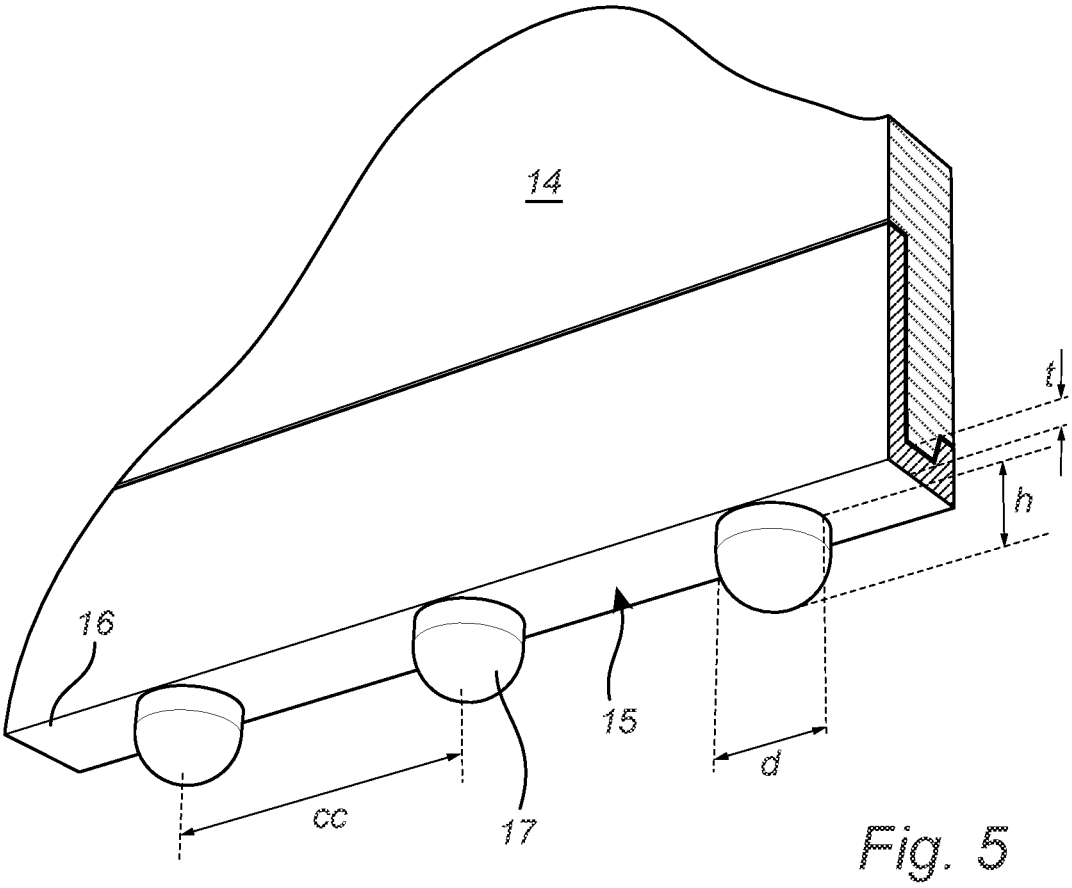
FIG. 5 is a perspective view of the tear unit as disclosed herein.

FIG. 4 shows the rounded protrusions 17 of thermoplastic elastomer 16 arranged at the outer edge of a dispensing opening 12 of a dispenser 10. The rounded protrusions 17 extend downwards away from the dispenser 10. A paper tail is present in the dispensing opening 12, hanging freely downwards. The paper tail may be grabbed, pulled downwards to unwind a desired length of web from the paper roll, and the pulled outwards in a perpendicular motion so that the web of paper comes into contact with the tear unit 13, thereby initiating a separation of a piece of tissue paper.

With continued reference to FIGS. 1-4, FIG. 5 shows the rounded protrusions 17 of thermoplastic elastomer 16. The thermoplastic elastomer 16 covers the friction surface 15 of the tear unit body 14 and extends over the edges of the friction surface 15 such as to partly cover the inner surface and outer surface of the tear unit body 14. The tear unit body 14 comprises a recessed portion along its inner surface and a recessed portion along its outer surface, the recessed portions being covered by the thermoplastic elastomer 16. The recessed portion at the inner surface of the tear unit body 14 is larger than the recessed portion at the outer surface of the tear unit body 14, i.e. extends further up the height of the tear unit body 14. The thermoplastic elastomer 16 extends further up the inner surface of the tear unit body 14 than at the outer surface of the tear unit body 14 and hence provides more thermoplastic elastomer 16 material at the inner surface, facing the interior of the housing 11 from where the web of paper is drawn. The recessed portions provide improved molding of the thermoplastic elastomer 16 to the tear unit body 14 during the injection molding formation step.

The rounded protrusions 17 are evenly distributed with a set distance (cc) between each protrusion. The rounded protrusions 17 are made of thermoplastic elastomer 16, and formed during injection molding the thermoplastic elastomer 16 to the tear unit 13. The surface between the rounded protrusions 17 is covered with thermoplastic elastomer 16 material, like a coating, having a set thickness (t).

In a non-limiting example the rounded protrusions 17 are arranged at a distance 10 mm from each other centre-to-centre (cc), the height (h) of the protrusions 17 is 2 mm, the diameter (d) of the rounded protrusions 17 is 3 mm and the thickness (t) of the thermoplastic elastomer 16 is 4 mm in between the rounded protrusions 17.

Figure 6A:
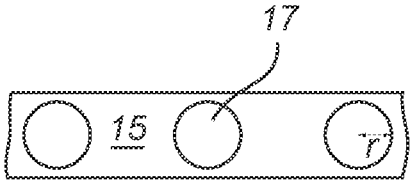
FIG. 6A-6B is a cross sectional top view of the rounded protrusions as disclosed herein.
Figure 6B:
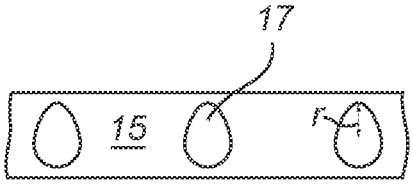

FIG. 6A shows the radius of a rounded protrusion with fixed radius (r). According to a non-limiting example shown in FIG. 6B the radius (r) of the rounded protrusions 17 may vary over the circumference of the rounded protrusions 17 such that for example the front of the protrusions have a larger radius (r) than the back of the protrusions 17 having a smaller radius (r). The front edge of the protrusions 17 is the side facing outwards from the dispensing opening 12, and the back edge is the side facing inwards towards the dispensing opening 12, the interior of the housing 11 and the web of paper.

Figure 6C:
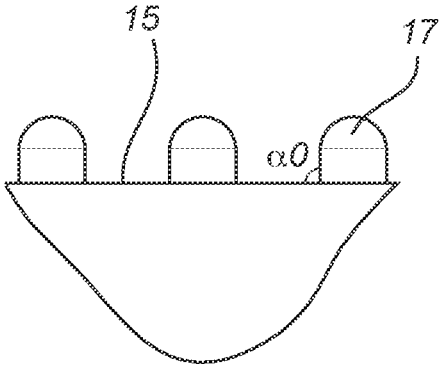
FIG. 6C-6D is a cross sectional side view of the rounded protrusions as disclosed herein.
Figure 6D:
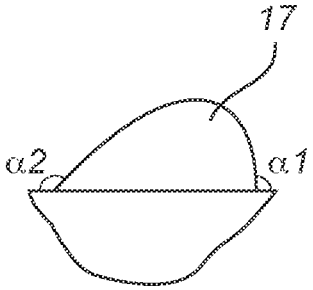

Moreover, the angle (a) between the plane of the intermediate surface between the rounded protrusions 17 and the slanted side of the rounded protrusions 17 may vary with the circumference of the rounded protrusions 17. In such a non-limiting example, shown in FIG. 6D, the angle ($\alpha$1) at the front edge of the rounded protrusion is 90 degrees, and the angle ($\alpha$2) at the back edge of the rounded protrusions 17 is less than 90 degrees so as to render more material at the back edge. The back edge is more prone to wear over time as the tissue paper is pulled from that direction over the tear unit 13. In FIG. 6C an example of rounded protrusions 17 with fixed angles ($\alpha$0) throughout their circumference is shown.

Figure 7:
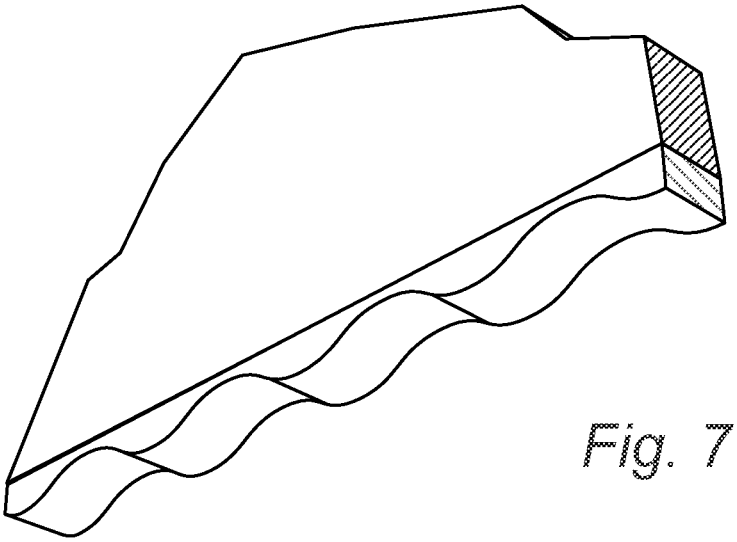
FIG. 7 is a perspective view of an alternative tear unit as disclosed herein.

FIG. 7 shows an alternative embodiment, a tear unit with rounded protrusions of elastomer being wave-shaped.

Example

The force required to break the tissue paper against the tear unit can be measured in the test method exemplified herein. The test results are used for comparative purposes.

Procedure

A tensile tester and a fixture are used to test the dispensability of the teeth of a dispenser. A clamp is attached to the tail of the paper, and the clamp is attached by a string to a tensile tester at the other end. The tail of the paper rests against the tear unit at the start of the test. The tensile tester pulls the paper for 300 mm with a speed of 10 000 mm/min and register the maximum load (N) and the extension (mm) before the tissue paper breaks. With this set up it is possible to measure how far the paper must be pulled before it breaks (extension at max load). Short distance (low extension at max load) represents a more effective tear, i.e. an effective tear unit.

Tensile tester Zwick/Roell Z1.0 was used at speed 10 000 mm/min with load cell 200 N.

The dispenser used was a roll dispenser with a vertically arranged roll, i.e. the side surface of the roll facing the tear unit. Such a dispenser type is shown in FIG. 1. The dispenser was equipped with a tear unit comprising conventional tear teeth of 30% glass fiber reinforced Polyamide 6 (SCHULAMID 66 GF30), a tear unit as disclosed herein, and a tear unit coated with TPE but without the rounded protrusions respectively. Conventional 2-ply toilet tissue paper was used (Tork Mini Jumbo Toilet Roll, available through www.tork.se).

Results

The test results for the max load and extension at max load are shown in Table 1.

TABLE 1

| | Roll diameter (mm) | Max load (N) | Extension at max load (mm) | Tear off success rate (%) |
|---|---|---|---|---|
| Dispenser with conventional tear teeth | Full roll | 6.2 | 89 | 17 |
| | 60 mm roll | 4.7 | 124 | 100 |
| Dispenser with tear unit as disclosed herein (rounded protrusions of TPE) | Full roll | 6.5 | 30 | 100 |
| | 60 mm roll | 6.2 | 31 | 100 |
| Dispenser with tear unit coated with TPE (without rounded protrusions) | Full roll | 8.3 | 102 | 33 |
| | 60 mm roll | 12.4 | 77 | 20 |

The dispenser with tear unit as disclosed herein provides reliable and precise tear off. The max load (N) needed to achieve tear in a web of paper is 6-7N which is comparable to the max load measured for a dispenser with a conventional tear teeth. However, the extension at maximum load is considerably less for a tear unit as disclosed herein than conventional tear teeth.

As can be seen from the comparative result the dispenser according to the present disclosure displays a lower extension at max load than the other dispensers tested (with other tear units). The reduced extension at max load indicate that the tear is more precise and achieved faster with tear means as disclosed herein. Full rolls and rolls of 60 mm radius, which represent about 50% of the tissue paper left on the roll, has been tested. The effectiveness of the tear with a tear unit as disclosed herein is not affected by the amount of tissue paper left on the roll and hence the performance is reliable and consistent. Shredding or unsuccessful breaking is avoided, thereby providing a good tear off success rate. A tear unit coated with thermoplastic elastomer but without the rounded protrusions repeatedly failed to break the tissue paper, i.e. resulted in unsuccessful tear off. In summary, a combination of thermoplastic elastomer material and rounded protrusions of the same material achieve the optimal tear performance.

The invention claimed is:

1. A tear unit for a dispenser for dispensing web of paper, the tear unit comprising a tear unit body, said tear unit body comprising a friction surface provided with an elastomer, and wherein said elastomer comprises rounded protrusions distributed along the friction surface such as to facilitate tearing during dispensing of paper, wherein said rounded protrusions are rounded in all directions.

2. The tear unit according to claim 1, wherein the rounded protrusions are evenly distributed along the friction surface.

3. The tear unit according to claim 1, wherein the rounded protrusions are arranged at a center-to-center distance from each other, the distance being larger than the maximum diameter of the rounded protrusions.

4. The tear unit according to claim 1, wherein said rounded protrusions have a height/diameter ratio of about 2/3.

5. The tear unit according to claim 1, wherein the height of said protrusions is less than 4 mm.

6. The tear unit according to claim 1, wherein the elastomer is a thermoplastic elastomer.

7. The tear unit according to claim 6, wherein said thermoplastic elastomer has a hardness of 70-90 Shore A.

8. The tear unit according to claim 7, wherein said thermoplastic elastomer is overmolded onto said tear unit body.

9. A dispenser for dispensing web of paper, the dispenser comprising:

a housing, a dispensing opening defined in said housing for dispensing paper; and a tear unit according to claim 1, which unit is arranged at the dispensing opening for facilitating tear of the paper upon moving the tissue paper over the tear unit.

10. The dispenser according to claim 9, wherein said housing comprises a housing body and a cover, the cover allowing access into the housing for refilling the dispenser.

11. The dispenser according to claim 9, wherein the tear unit is arranged at least at one edge defining the dispensing opening.

12. The dispenser according to claim 9, wherein the dispenser is a roll dispenser.

13. The dispenser according to claim 12, the dispenser comprising a housing for accommodating at least one roll.

14. The dispenser according to claim 9, wherein the dispenser is a roll dispenser, and said tear unit is arranged to mainly extend in a direction parallel to the direction of the central axis of a paper roll when arranged in said dispenser, such that the outer cylindrical surface of said paper roll faces said tear unit during dispensing.

15. The dispenser according to claim 9, wherein the dispenser is a roll dispenser, and wherein said tear unit is arranged to mainly extend in a direction perpendicular to the direction of the central axis of said paper roll such that a side of said paper roll faces said tear unit during dispensing.

16. The dispenser according to claim 9, wherein said dispenser comprises at least one roll holder for rotatably supporting an axis of a roll of paper.

17. The dispenser according to claim 16, wherein said tear unit is arranged at a distance from said at least one roll holder, and wherein said distance between the central axis of said roll holder and the periphery of a full paper roll arranged on the roll holder is smaller than the distance between the central axis of the roll holder and the tear unit.

18. The dispenser according to claim 9, wherein said tear unit is arranged to mainly extend in a direction parallel to the direction of the width of a stack of paper when arranged in said dispenser, such that the unfolding surface of said stack of paper faces said tear unit during dispensing.

19. The dispenser according to claim 9, wherein the paper is tissue paper.

20. A method for manufacturing a tear unit for a dispenser for dispensing web of paper, wherein the method comprises providing a tear unit body comprising a friction surface, wherein the method further comprises the step of providing the friction surface with a thermoplastic elastomer comprising rounded protrusions by injection molding, and wherein the rounded protrusions are distributed along the friction surface, wherein the rounded protrusions are evenly distributed along the tear unit and are rounded in all directions such that the rounded protrusions are dome-shaped.

* * * * *